US007325534B1

(12) United States Patent
Waters et al.

(10) Patent No.: US 7,325,534 B1
(45) Date of Patent: Feb. 5, 2008

(54) SUPPLEMENTAL INTERNAL AIR COOLING OF AN INTERNAL COMBUSTION ENGINE

(75) Inventors: James P. Waters, Waterford, MI (US); Jon C. Darrow, Brighton, MI (US); Timothy W. Kunz, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/651,732

(22) Filed: Jan. 10, 2007

(51) Int. Cl.
*F02B 15/00* (2006.01)
*F02B 15/02* (2006.01)

(52) U.S. Cl. ..... 123/432; 123/41.15; 123/198 DB

(58) Field of Classification Search ..... 123/432, 123/394, 332, 481, 41.13, 41.15, 198 D, 123/198 DB
See application file for complete search history.

(56) References Cited

U.S. PATENT DOCUMENTS 4,102,316 A * 7/1978 Valbert ..... 123/198 DB
4,126,114 A * 11/1978 Davis ..... 123/198 D
4,485,767 A * 12/1984 Baltz ..... 123/41.15
5,065,705 A * 11/1991 Fujimoto et al. ..... 123/41.15
5,732,680 A * 3/1998 Ninomiya et al. ..... 123/481

* cited by examiner

*Primary Examiner*—Mahmoud Gimie
(74) *Attorney, Agent, or Firm*—Paul L. Marshall

(57) ABSTRACT

A method for providing supplemental internal air cooling to a multi-cylinder internal combustion engine. The method involves deactivating the fuel injector to one cylinder for a predetermined time period or temperature decrease, based upon engine operating conditions, and then reactivating the fuel injector. This results in cool air being pumped through the fuel-deactivated cylinder by the reciprocating action of the piston therein, which air-cools the walls, piston, and head of that cylinder from the inside. In response to a controlling algorithm in an Engine Control Module, various of the engine fuel injectors may be deactivated and then reactivated sequentially to provide distributed cooling over the entire engine. The invention is especially useful for motorcycle engines having two or more cylinders when the motorcycles are used at low or stop-and-go speeds, such as in parades or other ceremonial functions.

8 Claims, 2 Drawing Sheets

SUPPLEMENTAL INTERNAL AIR COOLING OF AN INTERNAL COMBUSTION ENGINE

TECHNICAL FIELD

The present invention relates to cooling of an internal combustion engine (ICE); more particularly, to method and apparatus for cooling of such an engine by passage of air across engine surfaces; and most particularly, to a method and apparatus for supplemental air cooling of an ICE by passage of air through one or more cylinders wherein combustion is disabled.

BACKGROUND OF THE INVENTION

Internal combustion engines having a plurality of combustion cylinders are well known. Because of excess heat of combustion, all such engines require some means for cooling of engine components, typically by passage of either atmospheric air or water over engine components.

In air-cooled engines, outer engine surfaces are cooled by the passage of air across the surfaces. The air may be impelled by motion of the engine through the atmosphere, as in a moving motorized vehicle or aircraft, and/or by a supplemental fan.

In water-cooled engines, components such as block and head are jacketed, and cool water is passed through the jacket to remove heat from the components.

The water warmed by such passage is either discharged to the environment and replaced, as in marine vessels, or is circulated through a radiator system which itself is air cooled.

Engine cooling systems typically are sized to meet the thermal demands of engine operation over the full range of engine operating conditions. However, on some occasions an engine cooling system cannot keep up with the thermal demand, usually from lack of adequate coolant flow over the engine surfaces at low engine speeds or vehicle velocities. This problem is well-known, for example, in the field of motorcycle engines.

Certain motorcycles, usually large displacement, air-cooled V-twins, are commonly utilized in parades. However, parade speeds create a problem with these air-cooled engines, as these engines require significant speed-generated air flow across the cooling fins in order to reject the required heat from the combustion process to maintain a comfortable operator environment. Extended operation with negligible mass flow of ambient air across the engine cooling fins results in elevated engine operating temperature, which can be problematic for engine function and durability, as well as for an operator's comfort and safety.

Some motorcycles employ liquid cooling of the engine with a water jacket and remote radiator to facilitate rejection of combustion heat. These radiators also require vehicle speed to generate air flow through the radiator to function as an effective heat exchanger/rejecter. Unless an additional cooling fan is added to create airflow across the radiator, motorcycles with these liquid cooled engines are also susceptible to overheating during extended operation in a parade environment, although perhaps to a lesser degree than air-cooled motorcycles.

An approach to solving this problem in the prior art includes deactivation of the valvetrain of a selected cylinder to prevent further combustion therein. This approach has the effect of preventing generation of additional heat of combustion from the deactivated cylinder or cylinders, but since air in the cylinder is captive, this action does not act further to remove excess heat from the engine, resulting in a rather ineffective strategy for reducing engine over-heat during extended low-rpm, low road speed operation, with significant additional cost, mass, and complexity.

What is needed in the art is a method and apparatus for providing additional air cooling to an internal combustion engine during periods of excessive heat generation.

It is a principal object of the present invention to cool an internal combustion engine at times of low engine load and excessive heat generation.

SUMMARY OF THE INVENTION

Briefly described, a method of the present invention for providing supplemental internal air cooling to a multi-cylinder internal combustion engine involves deactivating the fuel supply (fuel injector) to one or more cylinders for a predetermined time period, based upon engine operating conditions, and then reactivating the fuel supply. This results in cool ambient air being pumped through the fuel-deactivated cylinder during the predetermined deactivation time period by the reciprocating action of the piston therein and normal actuation of the intake and exhaust valves, which has the effect of air-cooling the walls, piston, and head of that cylinder from the inside. In response to a controlling algorithm, various of the cylinder fuel injectors may be deactivated and then reactivated sequentially to provide distributed cooling over the entire engine. Providing supplemental internal air cooling in accordance with the invention is especially useful for motorcycle engines having two or more cylinders when the motorcycles are used at low or stop-and-go speeds, such as in parades or other ceremonial functions.

BRIEF DESCRIPTION OF THE DRAWINGS

The present invention will now be described, by way of example, with reference to the accompanying drawings, in which.

The exemplification set out herein illustrates one preferred embodiment of the invention, in one form, and such exemplification is not to be construed as limiting the scope of the invention in any manner.

DESCRIPTION OF THE PREFERRED EMBODIMENTS

The present invention involves shutting off of fuel to alternate cylinders of a multi-cylinder internal combustion engine to provide supplemental internal air-cooling of the engine. This is a software-based control strategy, requiring no additional hardware and hence no additional cost or mass, beyond the cost of algorithm development.

Figure 1:
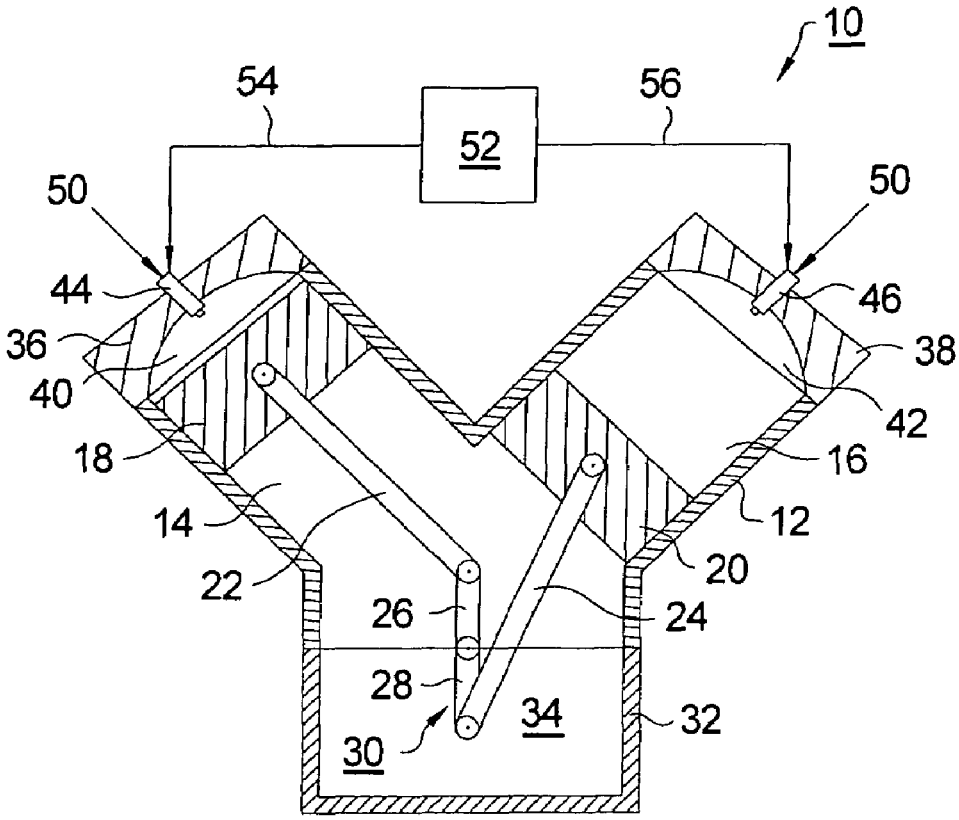
FIG. 1 is a cross-sectional view of an idealized V-block two-cylinder internal combustion engine equipped for operation in accordance with the invention.

Referring to FIG. 1, an idealized V-block two-cylinder internal combustion engine 10 includes a block 12 having a first cylinder 14 and a second cylinder 16, formed at an angle to one another. While the example shown in FIG. 1 depicts a 90° V-block, it is understood that any V-block formation can be used including, for examples, a 60° V-block or a 45° V-block. First and second pistons 18,20 having first and second connecting rods 22,24 are disposed in first and second cylinders 14,16, respectively. Connecting rods 22,24 are connected respectively to first and second throws 26,28 of crankshaft 30 which is mounted to the bottom surface of block 12. A crankcase 32 is mounted to block 12 for forming a sump for lubricating oil 34.

First and second cylinders 14,16 are closed respectively by first and second heads 36,38 having first and second firing chambers 40,42. First and second fuel delivery devices 44,46, such as for example fuel injectors or nozzles, are disposed in bores in heads 36,38 and extend into firing chambers 40,42 for injecting fuel 50 therein during normal operation of engine 10. In the example shown, the fuel delivery devices are simply shown as individual fuel injectors disposed in respective firing chambers. However, it is understood that the invention is equally applicable to other type fuel delivery systems including port fuel injection.

For simplicity of presentation, other well-known engine components, such as a camshaft, intake and exhaust valves, intake and exhaust manifolds, and sparking plugs, are omitted from FIG. 1 as not being directly relevant to the present invention. Note that the motions of first and second pistons 18,20 may be either out of phase, as shown in FIG. 1, or in phase (not shown) to equal effect in practice of the invention.

Still referring to FIG. 1, a programmable control means in the form of an electronic Engine Control Module (ECM) 52 communicates via signals 54,56 with first and second fuel injectors 44,46 for timing the actuation thereof in accordance with one or more algorithms programmed into ECM 52.

The present invention involves shutting off the fuel supply to one or more cylinder of a multi-cylinder engine, for a predetermined time period or temperature decline, based upon engine operating conditions. Such an engine may be a two-cylinder engine such as engine 10 or may be any other multi-cylinder engine, either air-cooled or water-cooled.

Figure 2:
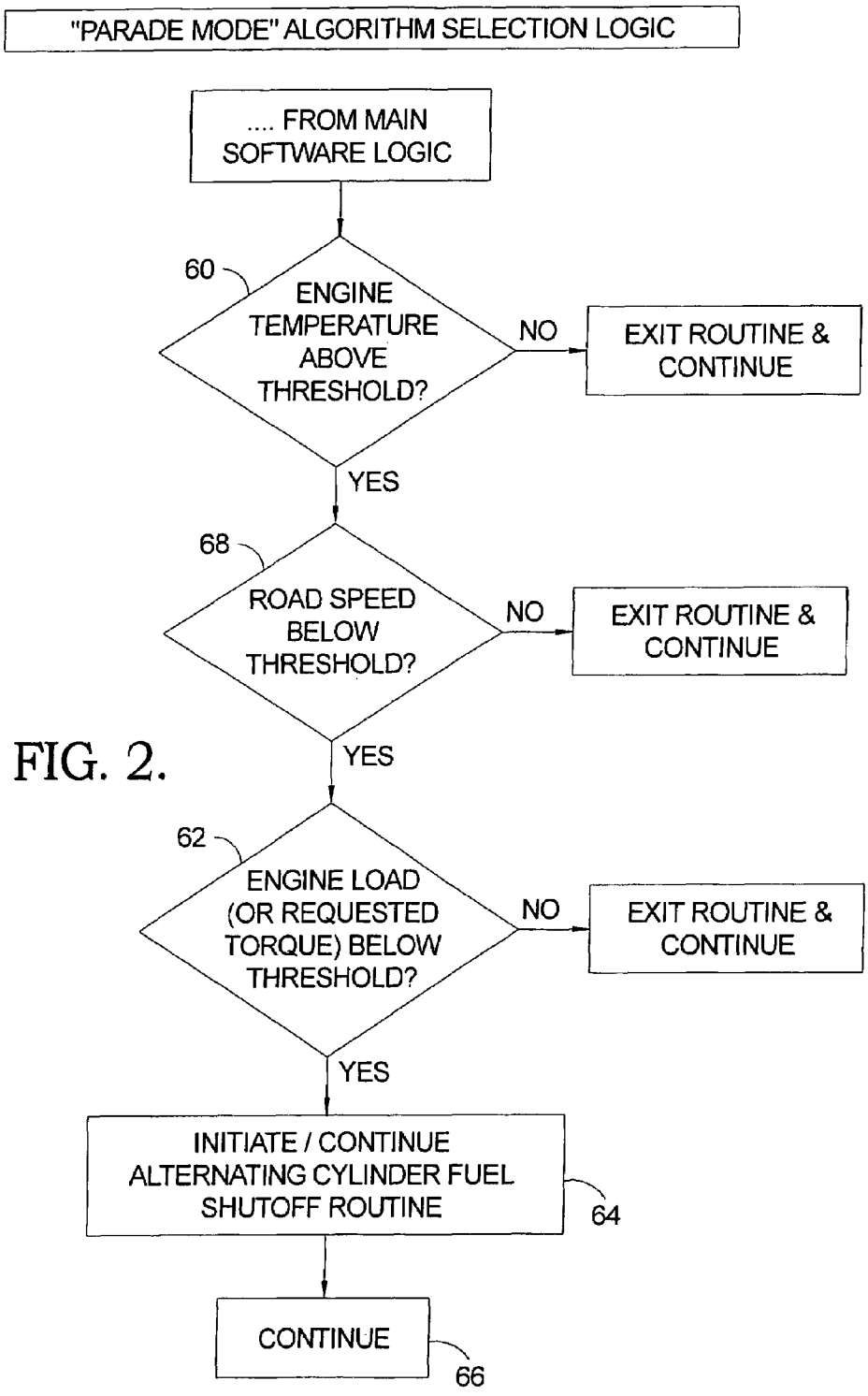
FIG. 2 is a schematic drawing of a decision tree for implementing supplemental internal air cooling in accordance with the invention.

Referring now to FIGS. 1 and 2, with respect to engine 10 a presently preferred method of the invention involves the following steps:

a) determining 60 that engine temperature is above a predetermined threshold temperature;

b) determining 62 that the engine load or requested torque is below a predetermined threshold value, such as would pertain during idling or low-speed operation;

c) shutting off 64 further fueling of firing chamber 40, thus allowing cool ambient air to be pumped through cylinder 14 by normal valve action to cool piston 18, head 36, and the walls of cylinder 14 from the inside;

d) determining that an operational goal has been reached, the goal being selected from the group consisting of a predetermined time period or a predetermined lower engine temperature; and e) restarting 66 fueling of firing chamber 40.

An additional step 68 of determining that vehicle road speed is below a threshold velocity may also be included as desired.

In a presently preferred embodiment, the method is then extended to second fuel injector 46 in second firing chamber 42, beginning at step 60.

In a multi-cylinder engine having more than two cylinders, the method may be extended to the next cylinder and then the next, again and again, until every cylinder has been internally air-cooled. Once every cylinder in the engine has been internally air cooled in this manner, the operating conditions of the engine are re-evaluated to determine if additional cycles of this protocol are required, or if the desired reduction in overall engine operating temperature has been achieved.

The cycle of shutting off fuel supply to individual cylinders is initiated whenever the engine control system determines that engine operating conditions require it. One possible embodiment is initiated by the presence of a combination of elevated engine temperature and extended operation at an engine rpm and vehicle road speed consistent with extended idling at little or no forward road speed. This condition is referred to herein (see FIG. 2) as "Parade Mode", wherein a motorcycle is required to operate with little or no forward motion for an extended period of time.

A simpler but less discriminating alternative method embodiment may be initiated by elevated temperature only, without consideration of engine rpm and/or road speed. Engine temperature may be determined any number of ways, including but not limited to oil temperature sensor, engine metal temperature sensor, or some combination of sensor or sensors and/or an engine temperature estimator algorithm. This cycle of shutting off fuel supply to individual cylinders may be interrupted whenever an operator input is received requesting normal, non-parade-mode vehicle performance, as by a request for immediate acceleration or engine load.

The application of this invention to a large displacement air-cooled V-twin motorcycle engine, results in engine torque production that is characteristic of a large bore single cylinder engine, of which there are several in past and present commercial production. These large-bore single-cylinder motorcycles have achieved some commercial acceptance, and are routinely referred to as "thumpers" to those with domain knowledge in this area.

This invention has the additional benefit of lying dormant in the engine control software, totally unobtrusive to normal vehicle operation until it is called upon to perform its desired function.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for providing supplemental internal air cooling to a multi-cylinder internal combustion engine, comprising the steps of:

a) determining that engine temperature is above a predetermined threshold temperature;

b) selecting a first cylinder for cooling in said engine;

c) shutting off further fueling of said first cylinder while continuing normal valve actuation in said first cylinder;

d) determining that an operational goal has been reached; and e) restarting fueling of said first cylinder.

2. A method in accordance with claim 1 comprising the further steps, before said shutting off step, of:

determining that at least one of engine load and requested torque is below a predetermined threshold value.

3. A method in accordance with claim 2 comprising the further step of determining that vehicle road speed is below a predetermined threshold velocity.

4. A method in accordance with claim 1 wherein said operational goal is selected from the group consisting of a predetermined time period and a predetermined engine temperature.

5. A method in accordance with claim 1 wherein said operational goal is selected from the group consisting of a predetermined engine load and a predetermined acceleration of a vehicle driven by said engine.

6. A method in accordance with claim 1 comprising the further steps of:

a) selecting a second cylinder for cooling in said engine; and b) performing claim 1 steps c) through e) for said second cylinder.

7. A method in an internal combustion engine having a plurality of combustion cylinders fueled in a sequence by individual fuel delivery devices, and having a programmable controller for controlling the timing of fueling by the individual fuel delivery devices, the improvement comprising an algorithm in said programmable controller, wherein said algorithm includes the steps of determining that engine temperature is above a predetermined threshold temperature; selecting a first cylinder from among said plurality of cylinders; shutting off further fueling of said selected first cylinder by deactivating a first fuel delivery device in said first cylinder; determining that an operational goal has been reached; and restarting fueling of said selected first cylinder by reactivating said first fuel delivery device.

8. The method in accordance with claim 7 wherein said algorithm includes the additional steps of:

a) selecting a second cylinder from among said plurality of cylinders; and b) repeating the steps of claim 7 for said selected second cylinder.

* * * * *